US010292250B2

(12) United States Patent
Adachi et al.

(10) Patent No.: US 10,292,250 B2
(45) Date of Patent: May 14, 2019

(54) ESD PROTECTION DEVICE

(71) Applicant: Murata Manufacturing Co., Ltd., Nagaokakyo-shi, Kyoto-fu (JP)

(72) Inventors: Jun Adachi, Nagaokakyo (JP); Takeshi Miki, Nagaokakyo (JP); Takahiro Sumi, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 15/834,187

(22) Filed: Dec. 7, 2017

(65) Prior Publication Data

US 2018/0098410 A1 Apr. 5, 2018

Related U.S. Application Data

(63) Continuation of application No. PCT/JP2016/067689, filed on Jun. 14, 2016.

(30) Foreign Application Priority Data

Jul. 28, 2015 (JP) ..... 2015-148784

(51) Int. Cl.
*H05F 3/00* (2006.01)
*H05F 3/04* (2006.01)
(Continued)

(52) U.S. Cl.
CPC ..... *H05F 3/04* (2013.01); *H01T 1/20* (2013.01); *H01T 2/02* (2013.01); *H01T 4/10* (2013.01); *H01T 4/12* (2013.01)

(58) Field of Classification Search
None
See application file for complete search history.

(56) References Cited

U.S. PATENT DOCUMENTS 5,807,509 A 9/1998 Shrier et al.
2016/0081172 A1 3/2016 Otsubo
2017/0093150 A1* 3/2017 Sumi ..... H01T 4/12

FOREIGN PATENT DOCUMENTS

JP 10-503054 A 3/1998
JP 2000-243534 A 9/2000
(Continued)

OTHER PUBLICATIONS

Official Communication issued in International Patent Application No. PCT/JP2016/067689, dated Aug. 9, 2016.

*Primary Examiner* — Stephen W Jackson
(74) *Attorney, Agent, or Firm* — Keating & Bennett, LLP

(57) ABSTRACT

An ESD protection device includes an insulating ceramic body including a cavity portion, an auxiliary electrode including a first and second main surfaces, the auxiliary electrode being embedded in the insulating ceramic body such that a side end portion of the auxiliary electrode between the first and second main surfaces is exposed to the cavity portion, and first and second discharge electrodes embedded in the insulating ceramic body such that main surfaces of the first and second discharge electrodes face each other with the auxiliary electrode interposed therebetween, the auxiliary electrode including first and second auxiliary electrode layers, the first auxiliary electrode layer having a higher content of a conductive material than the second auxiliary electrode layer, the first auxiliary electrode layer being joined to at least one of the first and second discharge electrodes.

20 Claims, 5 Drawing Sheets

(51) Int. Cl.

| | |
|---|---|
| ***H01T 1/20*** | (2006.01) |
| ***H01T 2/02*** | (2006.01) |
| ***H01T 4/10*** | (2006.01) |
| ***H01T 4/12*** | (2006.01) |

(56) References Cited

FOREIGN PATENT DOCUMENTS

| | | | |
|---|---|---|---|
| JP | 2010-129320 | A | 6/2010 |
| JP | 2010-153719 | A | 7/2010 |
| JP | 2012-114351 | A | 6/2012 |
| WO | 2014/208215 | A1 | 12/2014 |

* cited by examiner

ESD PROTECTION DEVICE

CROSS REFERENCE TO RELATED APPLICATIONS

This application claims the benefit of priority to Japanese Patent Application No. 2015-148784 filed on Jul. 28, 2015 and is a Continuation Application of PCT Application No. PCT/JP2016/067689 filed on Jun. 14, 2016. The entire contents of each application are hereby incorporated herein by reference.

BACKGROUND OF THE INVENTION

1. Field of the Invention

The present invention relates to an ESD protection device.

2. Description of the Related Art

Electro-static discharge (ESD) refers to a discharge phenomenon that occurs when, for example, the human body comes into contact with an electronic apparatus, and causes damage to and malfunction of the electronic apparatus. ESD protection devices are devices that protect electronic apparatuses from the application of overcurrent generated during discharge.

ESD protection devices have a structure in which a pair of discharge electrodes face each other with a distance maintained therebetween. When overvoltage is applied, discharge occurs between the discharge electrodes to guide static electricity to the ground side, thus protecting circuits. In recent years, electronic apparatuses that operate at lower voltages have been widely used. This requires an ESD protection device whose discharge starting voltage is low, in other words, an ESD protection device that allows discharge to occur at a lower voltage.

For example, Japanese Unexamined Patent Application Publication No. 2010-129320 describes an ESD protection device including an insulating substrate with a cavity portion inside thereof, a first discharge electrode, a second discharge electrode, and an auxiliary electrode that is arranged on at least a portion of the inner periphery of the cavity portion and that is electrically connected to the first discharge electrode and the second discharge electrode.

In the cavity portion, discharge occurs primarily along the inner periphery of the cavity portion (referred to as "surface discharge"). In the ESD protection device described in Japanese Unexamined Patent Application Publication No. 2010-129320, the arrangement of the auxiliary electrode on at least a portion of the inner periphery of the cavity portion facilitates the generation of the surface discharge, thus resulting in improved stability of ESD characteristics.

In recent years, however, there has been a need for an ESD protection device that enables discharge to occur at a lower voltage and that has high resistance to insulation degradation.

SUMMARY OF THE INVENTION

Preferred embodiments of the present invention provide ESD protection devices that have a lower discharge starting voltage and improved resistance to insulation degradation.

The inventors have conducted intensive studies and have discovered that it is possible to further reduce a discharge starting voltage and improve resistance to insulation degradation by arranging an auxiliary electrode including a plurality of layers, one of the layers including a larger amount of conductive material being located on the side of a discharge electrode.

An ESD protection device according to a preferred embodiment of the present invention includes an insulating ceramic body including a cavity portion; an auxiliary electrode including a first main surface and a second main surface, the auxiliary electrode being embedded in the insulating ceramic body such that a side end portion of the auxiliary electrode between the first main surface and the second main surface is exposed to the cavity portion; and a first discharge electrode and a second discharge electrode that are embedded in the insulating ceramic body such that a main surface of the first discharge electrode and a main surface of the second discharge electrode face each other with the auxiliary electrode interposed therebetween. The auxiliary electrode includes at least one first auxiliary electrode layer and at least one second auxiliary electrode layer, the first auxiliary electrode layer having a higher content of a conductive material than the second auxiliary electrode layer, the first auxiliary electrode layer being joined to at least one of the first discharge electrode and the second discharge electrode.

An ESD protection device according to a preferred embodiment of the present invention has a multilayer structure including at least two layers: the first auxiliary electrode layer and the second auxiliary electrode layer that have different contents of the conductive material and that are alternately arranged. The first auxiliary electrode layer having a high content of the conductive material is joined to at least one of the first discharge electrode and the second discharge electrode, thus resulting in improved operating characteristics at a low voltage and improved resistance to insulation degradation.

In a preferred embodiment of the present invention, the first discharge electrode may include a first auxiliary conductor electrically connected to the auxiliary electrode, and the first auxiliary conductor may be arranged such that at least a portion of a main surface of the first auxiliary conductor is exposed to the cavity portion.

According to the preferred embodiment described above, the arrangement of the first auxiliary conductor is able to reduce or prevent the delamination of the discharge electrode even if discharge is repeated, thus resulting in improved stability of the operating characteristics.

In a preferred embodiment of the present invention, the first discharge electrode may include a first auxiliary conductor electrically connected to the auxiliary electrode, the second discharge electrode may include a second auxiliary conductor electrically connected to the auxiliary electrode, and the first auxiliary conductor and the second auxiliary conductor may be arranged such that at least a portion of a main surface of the first auxiliary conductor and at least a portion of a main surface of the second auxiliary conductor are exposed to the cavity portion.

According to the preferred embodiment described above, the arrangement of the first auxiliary conductor and the second auxiliary conductor is able to further reduce or prevent the delamination of the discharge electrode even if discharge is repeated, thus resulting in further improved stability of the operating characteristics.

In a preferred embodiment of the present invention, the conductive material may include a metal material and/or a semiconductor material.

According to the preferred embodiment described above, the use of the metal material and/or the semiconductor material as the conductive material provides the ESD protection device having good stability of the operating characteristics.

In a preferred embodiment of the present invention, the side end portion of the auxiliary electrode exposed to the cavity portion may include a surface having an irregular shape.

According to the preferred embodiment described above, the irregular shape provides the effects of promoting the emission of secondary electrons to reduce the discharge starting voltage and of increasing a heat dissipation area that dissipates heat generated by discharge to reduce or prevent an increase in the temperature of the auxiliary electrode.

In a preferred embodiment of the present invention, the second auxiliary electrode layer may have a larger thickness than the first auxiliary electrode layer.

According to the preferred embodiment described above, the auxiliary electrode is able to have further improved insulation.

In a preferred embodiment of the present invention, the auxiliary electrode may include a through hole in the cavity portion that has an annular shape.

According to the preferred embodiment described above, the surface discharge occurs along a surface of the auxiliary electrode exposed to the cavity portion. Thus, the stability of the ESD characteristics is improved.

In a preferred embodiment of the present invention, the auxiliary electrode may have a structure in which one first auxiliary electrode layer and one second auxiliary electrode layer are alternately laminated.

According to the preferred embodiment described above, the alternate lamination of the first auxiliary electrode layer and the second auxiliary electrode layer results in further improved insulation of the auxiliary electrode.

In a preferred embodiment of the present invention, the auxiliary electrode may have a three-layer structure in which one second auxiliary electrode layer is arranged between one first auxiliary electrode layer joined to the first discharge electrode and one first auxiliary electrode layer joined to the second discharge electrode.

According to the preferred embodiment described above, a streamer is able to propagate reliably from one of the discharge electrodes to the other discharge electrode, and the device may also be used as a bipolar ESD protection device.

According to various preferred embodiments of the present invention, it is possible to provide ESD protection devices with a lower discharge starting voltage and improved resistance to insulation degradation.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention will be described in detail below with reference to the drawings.

Figure 1A:
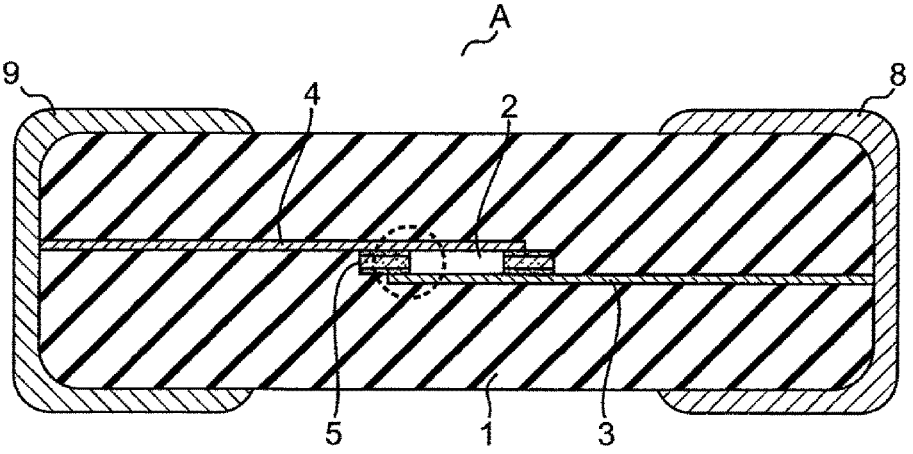
FIG. 1A is a schematic longitudinal sectional view illustrating an example of the structure of an ESD protection device according to a first preferred embodiment of the present invention.

FIG. 1A is a schematic longitudinal sectional view illustrating an example of the structure of an ESD protection device according to a first preferred embodiment of the present invention. An ESD protection device A includes an insulating ceramic body 1 including a cavity portion 2, an auxiliary electrode 5 including a first main surface 51 and a second main surface 52, the auxiliary electrode 5 being embedded in the insulating ceramic body 1 such that a side end portion of the auxiliary electrode 5 between the first main surface 51 and the second main surface 52 is exposed to the cavity portion 2, and a first discharge electrode 3 and a second discharge electrode 4 that are embedded in the insulating ceramic body 1 such that a main surface of the first discharge electrode 3 and a main surface of the second discharge electrode 4 face each other with the auxiliary electrode 5 interposed therebetween. A portion of the first discharge electrode 3 and a portion of the second discharge electrode 4 face each other with the cavity portion 2 interposed therebetween. In the following description, the portion of the first discharge electrode 3 and the portion of the second discharge electrode 4 facing each other are referred to as "facing portions", in some cases.

Figure 1B:
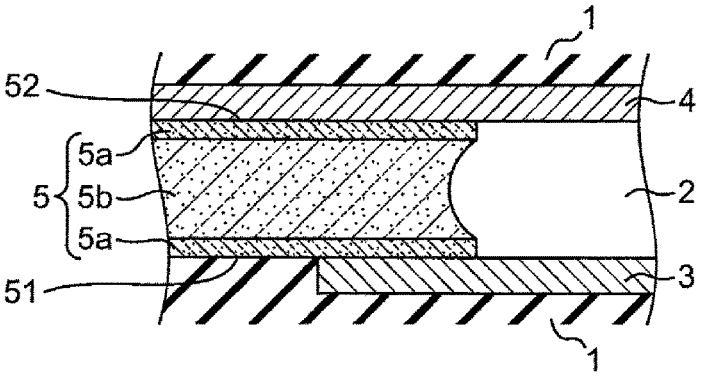
FIG. 1B is a partially enlarged sectional view of FIG. 1A.

FIG. 1B is a partially enlarged view of the auxiliary electrode 5 in FIG. 1A. The auxiliary electrode 5 has a three-layer structure in which first auxiliary electrode layers 5*a* and a second auxiliary electrode layer 5*b* are laminated. That is, first auxiliary electrode layer 5*a*/second auxiliary electrode layer 5*b*/first auxiliary electrode layer 5*a* are laminated in this order from the first discharge electrode 3 to the second discharge electrode 4. The first auxiliary electrode layers preferably have a higher content of a conductive material than the second auxiliary electrode layer. One of the two first auxiliary electrode layers is joined to the first discharge electrode, and the other is joined to the second discharge electrode.

In general, electrostatic discharge from the first discharge electrode to the second discharge electrode is caused by the concentration of an electric field on a triple point where the first discharge electrode 3, the auxiliary electrode 5, and the cavity portion 2 are in contact with one another (hereinafter, referred to as a "surface triple point"). Secondary electrons generated at the surface triple point produce dendritic discharge referred to as a streamer. The streamer further produces a leader and reaches the second discharge electrode along a surface of the auxiliary electrode 5. The discharge along the surface of the auxiliary electrode 5 is referred to as "surface discharge". A higher concentration of the electric field on the surface triple point facilitates the surface discharge and reduces the discharge starting voltage. A higher content of the conductive material in the entire auxiliary electrode results in a higher concentration of the electric field on the triple point and promotes the production of an electron avalanche due to the emission of the secondary electrons. However, at a larger amount of the conductive material, the repetition of discharge degrades the insulation and makes it difficult to achieve good resistance to insulation degradation.

In the present preferred embodiment, the auxiliary electrode has the three-layer structure, i.e., first auxiliary electrode layer 5*a*/second auxiliary electrode layer 5*b*/first auxiliary electrode layer 5*a*, and the first auxiliary electrode layer is joined to the first discharge electrode. This promotes the concentration of the electric field on the surface triple point, to facilitate the production of the streamer and the leader to reduce the discharge starting voltage. Once the streamer and the leader are produced, the growth of the surface discharge is not substantially reduced or prevented even in the presence of the second auxiliary electrode layer having a low content of the conductive material. Furthermore, the arrangement of the second auxiliary electrode layer, having a low content of the conductive material, adjacent to the first auxiliary electrode layers is less likely to lead to dielectric breakdown due to discharge. Thus, high insulation is maintained to improve resistance to insulation degradation even if discharge is repeated.

The use of the first auxiliary electrode layers and the second auxiliary electrode layer that have different contents of the conductive material results in different degrees of shrinkage during sintering. That is, the second auxiliary electrode layer having a low conductive material content shrinks more easily, as compared to the first auxiliary electrode layers. Thus, a side end portion of the auxiliary electrode exposed to the cavity portion includes an irregular surface (see FIG. 1B). The second auxiliary electrode layer includes a valley portion, and the first auxiliary electrode layers include ridged portions. The irregular surface has the effects of promoting the emission of secondary electrons to reduce the discharge starting voltage and of increasing a heat dissipation area to dissipate heat generated by discharge to reduce or prevent an increase in the temperature of the auxiliary electrode. The fact that the type of conductive material and the type of insulating material of the first auxiliary electrode layers and the second auxiliary electrode layer are changed to provide different degrees of shrinkage is also effective to provide the irregular surface.

A mixture of a conductive material and an insulating material, for example, may preferably be used for the first auxiliary electrode layers and the second auxiliary electrode layer. The conductive material preferably includes a metal material and a semiconductor material, for example. Examples of the conductive material include Cu, Ag, Pd, Pt, Al, Ni, W, and combinations thereof. Cu is preferred. Examples of the semiconductor material include metal semiconductors, such as Si and Ge, carbides, such as SiC, TiC, ZrC, and WC, nitrides, such as TiN, ZrN, chromium nitride, VN, and TaN, silicides such as titanium silicide, zirconium silicide, tungsten silicide, molybdenum silicide, and chromium silicide, borides such as titanium boride, zirconium boride, chromium boride, lanthanum boride, molybdenum boride, and tungsten boride, oxides such as strontium titanate. SiC is preferred. The foregoing metal materials and/or semiconductor materials may be used in appropriate combination as a mixture of two or more, for example. The conductive material may preferably be coated with an inorganic material. The inorganic material is not particularly limited as long as it is an inorganic material, and may be, for example, an inorganic material, such as $Al_2O_3$, $ZrO_2$, or $SiO_2$ or a calcined powder mixture of materials contained in a ceramic base. Examples of the insulating material include oxides, such as $Al_2O_3$, $SiO_2$, $ZrO_2$, and $TiO_2$, nitrides, such as $Si_3N_4$ and AlN, a calcined powder mixture of materials contained in a ceramic base, vitreous materials, and combinations thereof. Regarding a combination of the conductive material and the insulating material, preferably, the first auxiliary electrode layers include a combination of materials having a sintering temperature higher than that of the second auxiliary electrode layer.

The first auxiliary electrode layers preferably have a higher content of the conductive material than the second auxiliary electrode layer. Here, the content of the conductive material may be expressed as percent by volume of the conductive material with respect to (conductive material+insulating material). For example, in the case of a combination of the metal material and the insulating material, the first auxiliary electrode layers have a content of the conductive material of about 15% to about 50% by volume, preferably about 20% to about 40% by volume, for example. The content of the conductive material in the second auxiliary electrode layer may be lower than, for example, preferably about 3% to about 15% by volume lower than the content of the conductive material in the first auxiliary electrode layers. In the case of using the conductive material coated with an inorganic material or the semiconductor material, the first auxiliary electrode layers have a content of the conductive material of about 30% to about 90% by volume, preferably about 40% to about 80% by volume, for example. The content of the conductive material in the second auxiliary electrode layer may be lower than, for example, preferably about 7% to about 30% by volume lower than, the content of the conductive material in the first auxiliary electrode layers.

The thickness of the auxiliary electrode may be set, depending on the distance of a discharge gap (distance between the facing portions of the first discharge electrode and the second discharge electrode), and is about 3 μm to about 20 μm, preferably about 5 μm to about 15 μm, for example. The thicknesses of the first auxiliary electrode layers and the second auxiliary electrode layer may each be set in the range of about 0.5 μm to about 15 μm, preferably about 1 μm to about 10 μm, for example, depending on the thickness of the auxiliary electrode. The first auxiliary electrode layers and the second auxiliary electrode layer may have the same or different thicknesses. Preferably, the second auxiliary electrode layer has a larger thickness. The larger thickness facilitates a reduction or prevention of a short-circuit between the discharge electrodes.

The first auxiliary electrode layer having a high content of the conductive material is joined to at least one of the first discharge electrode and the second discharge electrode. In the case where one of the first discharge electrode and the second discharge electrode is joined, a two-layer structure, i.e., first auxiliary electrode layer/second auxiliary electrode layer, may be used. The first auxiliary electrode layers may be joined to both of the first discharge electrode and the second discharge electrode. In this case, a streamer propagates reliably from one discharge electrode to the other discharge electrode, and the device may be used as a bipolar ESD protection device, for example. In this case, multilayer structures that include the first auxiliary electrode layers and the second auxiliary electrode layers alternately laminated and that include various numbers of layers may be used. Examples thereof include a three-layer structure, i.e., first auxiliary electrode layer/second auxiliary electrode layer/first auxiliary electrode layer; a five-layer structure, i.e., first auxiliary electrode layer/second auxiliary electrode layer/first auxiliary electrode layer/second auxiliary electrode layer/first auxiliary electrode layer; and a seven-layer structure, i.e., first auxiliary electrode layer/second auxiliary electrode layer/first auxiliary electrode layer/second auxiliary electrode layer/first auxiliary electrode layer/second auxiliary electrode layer/first auxiliary electrode layer.

The shape of the auxiliary electrode 5 having a multilayer structure is not particularly limited. Preferably, an annular shape, for example, may be used when viewed from the lamination direction of the auxiliary electrode 5.

As a ceramic material included in the insulating ceramic body 1, for example, a low-temperature co-fired ceramic (LTCC) containing Ba, Al, and Si as main components may preferably be used. The insulating ceramic body 1 may include at least one of an alkali metal component and a boron component. In addition, a glass component may be included.

The first discharge electrode 3 and the second discharge electrode 4 are arranged in different planes. The first discharge electrode 3 and the second discharge electrode 4 extend in the directions of the different planes. The shape thereof is not particularly limited. For example, a strip shape may be used. The first discharge electrode 3 and the second discharge electrode 4 may preferably be made of, for example, a material such as Cu, Ag, Pd, Pt, Al, Ni, or W, or an alloy containing at least one thereof.

A first outer electrode 8 and a second outer electrode 9 may preferably be made of, for example, a material such as Cu, Ag, Pd, Pt, Al, Ni, or W, or an alloy containing at least one thereof.

The ESD protection device according to this preferred embodiment has a multilayer structure including at least two layers in which two auxiliary electrode layers (the first auxiliary electrode layer and the second auxiliary electrode layer) having different contents of the conductive material are alternately arranged, the first auxiliary electrode layer with a high content of the conductive material being joined to at least one of the first discharge electrode and the second discharge electrode, thus resulting in improved operating characteristics at a low voltage and improved resistance to insulation degradation.

A non-limiting example of a method for producing an ESD protection device according to the present preferred embodiment will be described below. The method for producing an ESD protection device includes the steps of forming a first discharge electrode and a second discharge electrode on respective main surfaces of a first ceramic green sheet and a second ceramic green sheet, forming an auxiliary electrode sheet including at least two layers in which two auxiliary electrode layers having different contents of a conductive material are alternately arranged, forming a through hole to be formed into a cavity portion in the auxiliary electrode sheet, forming a multilayer body by laminating the first ceramic green sheet and the second ceramic green sheet with the auxiliary electrode sheet interposed therebetween such that the first discharge electrode and the second discharge electrode are exposed to the through hole, and firing the multilayer body.

Figure 2:
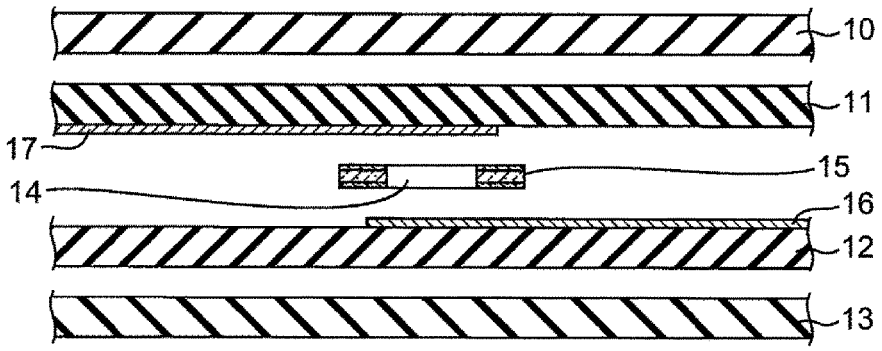
FIG. 2 is a schematic longitudinal sectional view illustrating an example of a production process of an ESD protection device according to the first preferred embodiment of the present invention.

The method for producing an ESD protection device according to the present preferred embodiment will be specifically described below with reference to FIG. 2.

(1) Step of Forming First Discharge Electrode and Second Discharge Electrode

A conductive paste is applied to ceramic green sheets 12 and 11 to form a first discharge electrode 16 and a second discharge electrode 17, respectively.

(2) Step of Forming Auxiliary Electrode Sheet Including at Least Two Layers

Slurries for two auxiliary electrode layers having different contents of the conductive material are prepared. First auxiliary electrode layer sheets (not illustrated) and a second auxiliary electrode layer sheet (not illustrated) are formed by a doctor blade method, for example. The first auxiliary electrode layer sheets and the second auxiliary electrode layer sheet are alternately laminated to form an auxiliary electrode sheet 15 having a three-layer structure.

(3) Step of Forming Through Hole to Be Formed into Cavity Portion in Auxiliary Electrode Sheet A through hole 14 to be formed into a cavity portion at the time of lamination is formed in the resulting auxiliary electrode sheet 15.

(4) Step of Forming Laminate

Ceramic green sheets 10, 11, 12, and 13 are laminated with the auxiliary electrode sheet 15 interposed therebetween in such a manner that the first discharge electrode and the second discharge electrode are exposed to the through hole to form a green sheet multilayer body.

(5) Step of Performing Firing

The green sheet multilayer body may be fired in the temperature range of about 850° C. to about 1,000° C. in a $N_2$ atmosphere, for example.

Second Preferred Embodiment

The ESD protection device according to the first preferred embodiment has a structure in which the first discharge electrode and the second discharge electrode partially face each other with the cavity portion interposed therebetween, whereas an ESD protection device according to a second preferred embodiment of the present invention has the same or substantially the same structure as the ESD protection device according to the first preferred embodiment, except that the first discharge electrode includes a first auxiliary conductor and that the first auxiliary conductor is arranged such that at least a portion of a main surface of the first auxiliary conductor is exposed to the cavity portion.

Figure 3A:
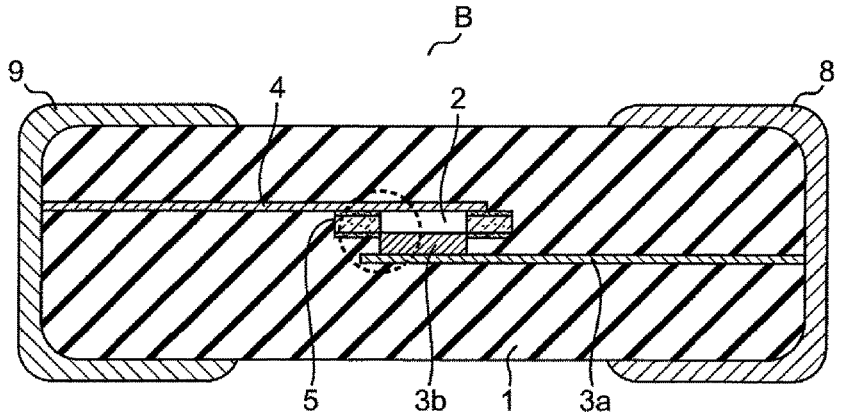
FIG. 3A is a schematic longitudinal sectional view illustrating an example of the structure of an ESD protection device according to a second preferred embodiment of the present invention.
Figure 3B:
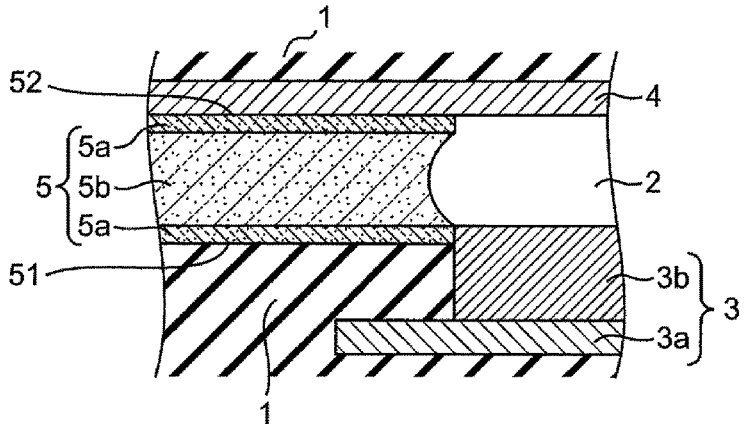
FIG. 3B is a partially enlarged sectional view of FIG. 3A.

As illustrated in FIG. 3A, the first discharge electrode includes a first main conductor 3*a* and a first auxiliary conductor 3*b*. FIG. 3B is a partially enlarged view of the auxiliary electrode 5. The auxiliary electrode 5 has a three-layer structure in which the first auxiliary electrode layers 5*a* and the second auxiliary electrode layer 5*b* are laminated, i.e., first auxiliary electrode layer 5*a*/second auxiliary electrode layer 5*b*/first auxiliary electrode layer 5*a* laminated in this order from the first discharge electrode 3 toward the second discharge electrode 4. The lower first auxiliary electrode layer 5*a* is joined to the first auxiliary conductor 3*b*, and the upper first auxiliary electrode layer 5*a* is joined to the second discharge electrode 4.

The first auxiliary conductor is a conductor used to inhibit the degradation of the main conductor due to the repetition of discharge. For example, a via conductor can be used in which a via hole in the insulating ceramic body is filled with a conductive material. Although FIGS. 3A and 3B illustrate a structure in which the first auxiliary conductor is joined to the main conductor, the first auxiliary conductor and the main conductor may be integrally provided. Hereinafter, the auxiliary conductor is also referred to as a "via conductor".

Figure 4:
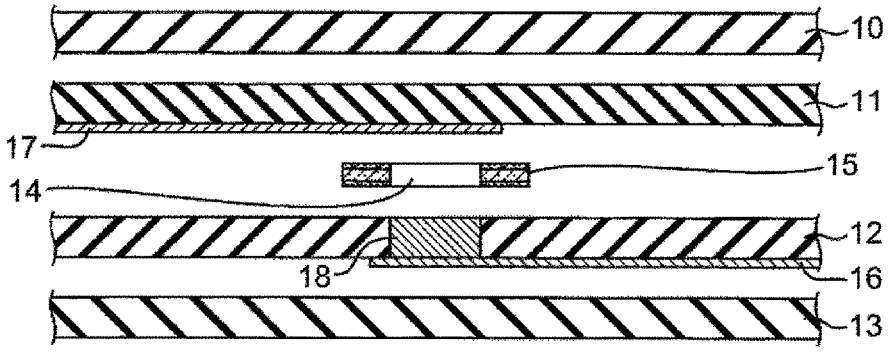
FIG. 4 is a schematic longitudinal sectional view illustrating an example of a production process of an ESD protection device according to the second preferred embodiment of the present invention.

The ESD protection device according to the present preferred embodiment may be produced in the same or substantially the same method as in the first preferred embodiment, except that in the step of forming the first discharge electrode and the second discharge electrode, the first auxiliary conductor is formed by forming a via hole in the ceramic green sheet on which the first discharge electrode is formed, and then filling the via hole with a conductor. FIG. 4 is a schematic sectional view illustrating an example of a production process. The ceramic green sheet 12 is used in which the via hole is filled with a first auxiliary conductor 18 and the first discharge electrode 16 is formed. The ceramic green sheets 10, 11, 12, and 13 are laminated with the auxiliary electrode sheet 15 interposed therebetween to form a green sheet multilayer body.

According to the present preferred embodiment, the same or similar advantageous effects as those of the ESD protection device according to the first preferred embodiment are provided. Furthermore, the arrangement of the first auxiliary conductor reduces or prevents the delamination of the discharge electrode even if discharge is repeated, thus resulting in improved stability of operating characteristics.

Third Preferred Embodiment

The ESD protection device according to the first preferred embodiment has a structure in which the first discharge electrode and the second discharge electrode partially face each other with the cavity portion interposed therebetween, whereas an ESD protection device according to a third preferred embodiment of the present invention has the same or substantially the same structure as the ESD protection device according to the first preferred embodiment, except that the first discharge electrode includes the first auxiliary conductor, at least a portion of a main surface of the first auxiliary conductor is exposed to the cavity portion, the second discharge electrode includes a second auxiliary conductor, and at least a portion of a main surface of the second auxiliary conductor is exposed to the cavity portion.

Figure 5A:
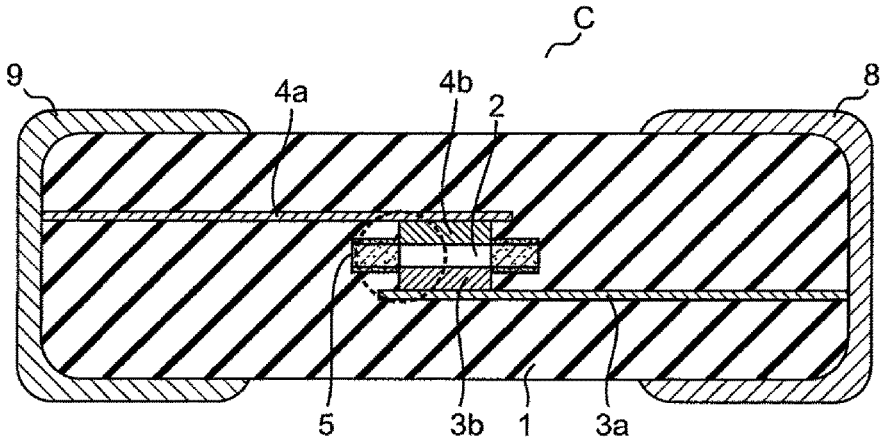
FIG. 5A is a schematic longitudinal sectional view illustrating an example of the structure of an ESD protection device according to a third preferred embodiment of the present invention.
Figure 5B:
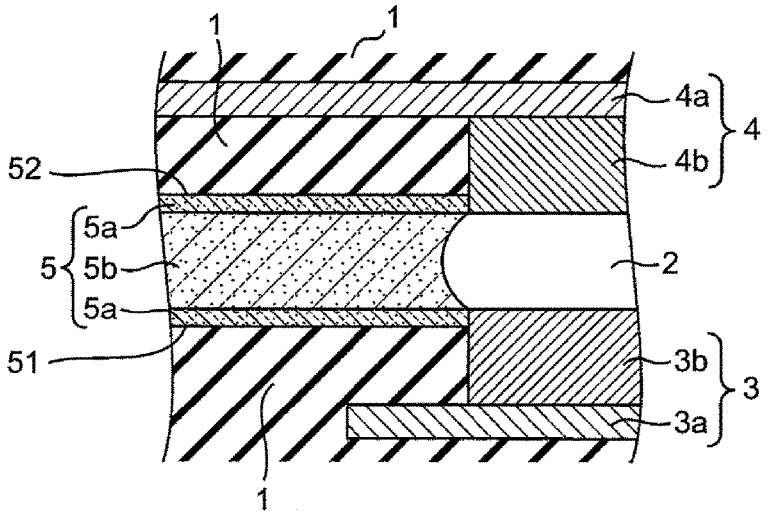
FIG. 5B is a partially enlarged sectional view of FIG. 5A.

As illustrated in FIG. 5A, the first discharge electrode 3 includes the first main conductor 3*a* and the first auxiliary conductor 3*b*, and the second discharge electrode 4 includes a second main conductor 4*a* and a second auxiliary conductor 4*b*. FIG. 5B is a partially enlarged view of the auxiliary electrode 5. The auxiliary electrode 5 has a three-layer structure in which the first auxiliary electrode layers 5*a* and the second auxiliary electrode layer 5*b* are laminated, i.e., first auxiliary electrode layer 5*a*/second auxiliary electrode layer 5*b*/first auxiliary electrode layer 5*a* laminated in this order from the first discharge electrode 3 toward the second discharge electrode 4. The lower first auxiliary electrode layer 5*a* is joined to the first auxiliary conductor 3*b*, and the upper first auxiliary electrode layer 5*a* is joined to the second auxiliary conductor 4*b*.

The ESD protection device according to the present preferred embodiment may be produced in the same or substantially method as in the first preferred embodiment, except that in the step of forming the first discharge electrode and the second discharge electrode, the first auxiliary conductor and the second auxiliary conductor are formed by forming a via hole in the ceramic green sheet on which the first discharge electrode is formed, forming a via hole in the ceramic green sheet on which the second discharge electrode is formed, filling these via holes with the conductor.

According to the present preferred embodiment, the same or similar advantageous effects as those of the ESD protection device according to the first preferred embodiment are provided. Furthermore, the arrangement of the auxiliary conductors above and below the cavity portion reduces or prevents the delamination of both the discharge electrodes even if discharge is repeated, thus resulting in further improved stability of operating characteristics.

Fourth Preferred Embodiment

The ESD protection device according to the second preferred embodiment includes the auxiliary electrode having a three-layer structure, whereas an ESD protection device according to a fourth preferred embodiment of the present invention has the same or substantially the same structure as the ESD protection device according to the second preferred embodiment, except that an auxiliary electrode having a five-layer structure is provided.

Figure 6:
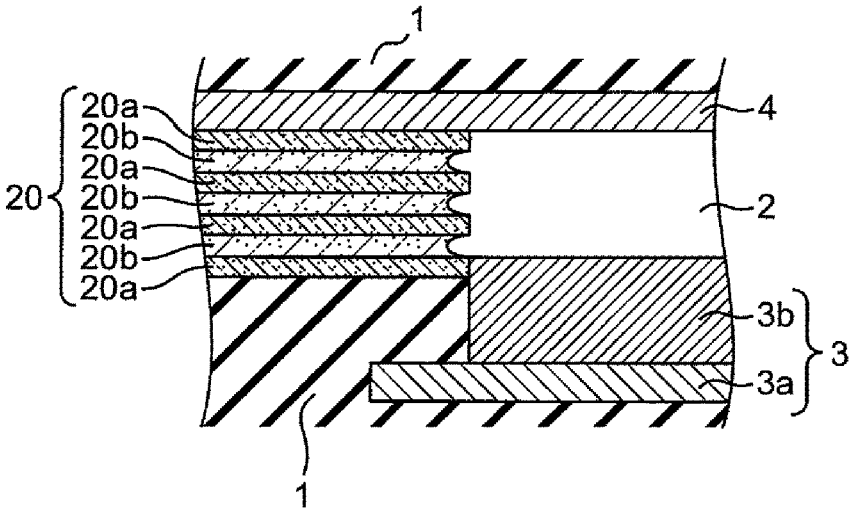
FIG. 6 is a partially enlarged sectional view illustrating an example of the structure of an ESD protection device according to a fourth preferred embodiment of the present invention.

FIG. 6 is a partial enlarged view of the auxiliary electrode 20. The auxiliary electrode 20 has a seven-layer structure in which the first auxiliary electrode layers 20*a* and the second auxiliary electrode layers 20*b* are laminated, i.e., first auxiliary electrode layer 20*a*/second auxiliary electrode layer 20*b*/first auxiliary electrode layer 20*a*/second auxiliary electrode layer 20*b*/first auxiliary electrode layer 20*a*/second auxiliary electrode layer 20*b*/first auxiliary electrode layer 20*a* laminated in this order from the first discharge electrode 3 toward the second discharge electrode 4. The lower first auxiliary electrode layer 20*a* is joined to the first auxiliary conductor 3*b*, and the upper first auxiliary electrode layer 20*a* is joined to the second discharge electrode 4. The second auxiliary electrode layers include valley portions, and the first auxiliary electrode layers include ridged portions. Thus, a side end portion of the auxiliary electrode exposed to the cavity portion includes an irregular surface in which the valley portions and the ridged portions are alternately arranged.

According to the present preferred embodiment, an increase in the number of the first auxiliary electrode layers and the second auxiliary electrode layers included in the auxiliary electrode facilitates the propagation of a streamer to result in a lower discharge starting voltage and further improved resistance to insulation degradation. In addition, a heat dissipation area that dissipates heat generated by discharge is further increased. Thus, the effect of further reducing or preventing an increase in the temperature of the auxiliary electrode is also provided.

While various preferred embodiments of the present invention will be described in more detail by examples, the present invention is not limited to the following examples.

Example 1

(1) Preparation of Material for Ceramic Sheet

Regarding ceramic materials for ceramic sheets, a material having a composition primarily containing Ba, Al, and Si (a material whose relative dielectric constant $\varepsilon_r$ was adjusted to 4 to 9 and is referred to as a "BAS material" hereinafter) was used. Materials were mixed such that a predetermined composition was obtained, and then calcined at about 800° C. to about 1,000° C. The calcined powder was pulverized for about 12 hours with a zirconia ball mill to prepare a ceramic powder. The ceramic powder was mixed with an organic solvent, such as toluene or Ekinen. The resulting mixture was then mixed with a binder and a plasticizer to prepare a slurry. The resulting slurry was formed into four ceramic green sheets having a thickness of about 25 μm by a doctor blade method.

(2) Preparation of Auxiliary Electrode Material

Two auxiliary electrode materials A and B were used for the auxiliary electrodes. The auxiliary electrode material A was a $Cu/Al_2O_3$ mixture. A Cu powder having an average particle size of about 0.5 μm and an $Al_2O_3$ powder having an average particle size of about 0.1 μm were mixed together in a ratio of about 35% by volume to about 65% by volume. The mixture was mixed with an organic solvent, such as toluene or Ekinen. The resulting mixture was then mixed with a binder and a plasticizer to prepare a slurry. The auxiliary electrode material B was a Cu/calcined BAS powder mixture. A Cu powder having an average particle size of about 0.5 μm and a calcined BAS powder whose average particle size was adjusted to about 0.5 μm were mixed in a ratio of about 30% by volume to about 70% by volume. The mixture was mixed with an organic solvent, such as toluene or Ekinen. The resulting mixture was then mixed with a binder and a plasticizer to prepare a slurry.

The resulting slurries were formed by a doctor blade method into an auxiliary electrode sheet having a three-layer structure of first auxiliary electrode/second auxiliary electrode/first auxiliary electrode. Specifically, two first auxiliary electrode sheets having a thickness of about 5 μm were formed with the auxiliary electrode material A. A single second auxiliary electrode sheet having a thickness of about 10 μm was formed with the auxiliary electrode material B. The first auxiliary electrode sheets were laminated with the second auxiliary electrode sheet interposed therebetween.

(3) Preparation of Paste Material for Via Conductor and Paste Material for Discharge Electrode (3-1) Preparation of Paste Material for Via Conductor About 85% by weight of a Cu powder having an average particle size of about 1 μm and about 15% by weight of an organic vehicle prepared by dissolving ethyl cellulose in terpineol were mixed together using a three-roll mill to prepare a via-conductor paste.

(3-2) Preparation of Discharge Electrode Paste

About 40% by weight of a Cu powder having an average particle size of about 1 μm and about 40% by weight of a Cu powder having an average particle size of about 3 μm, and about 20% by weight of an organic vehicle prepared by dissolving ethyl cellulose in terpineol were mixed together using a three-roll mill to prepare a discharge electrode paste.

(3-3) Preparation of Paste for Cavity Formation

About 38% by weight of crosslinked acrylic resin beads having an average particle size of about 1 μm and about 62% by weight of an organic vehicle prepared by dissolving about 10% by weight of Ethocel resin in terpineol were mixed together using a three-roll mill to prepare a paste for cavity formation.

(3-4) Preparation of Outer Electrode Paste

About 80% by weight of a Cu powder having an average particle size of about 1 μm, about 5% by weight of an alkaline borosilicate-based glass frit having a transition point of about 620° C., a softening point of about 720° C., and an average particle size of about 1 μm, and about 15% by weight of an organic vehicle prepared by dissolving ethyl cellulose in terpineol were mixed together using a three-roll mill to prepare an outer electrode paste.

(4) Formation of Via Ole by Laser Processing and Filling

Via holes were formed in the ceramic green sheet and the auxiliary electrode sheet with a $CO_2$ laser. The via hole having a diameter of about 130 μm was formed in the ceramic green sheet and filled with the via-conductor paste. The via hole having a diameter of about 130 μm was formed in the auxiliary electrode sheet and filled with the paste for cavity formation. Then a piece having a predetermined size was cut from the auxiliary electrode sheet and used to form a discharge portion at the time of lamination.

(5) Application of Discharge Electrode by Screen Printing

The discharge electrode paste was applied by screen printing. The discharge electrode paste was applied to one ceramic green sheet without a via hole and the ceramic green sheet in which the via hole had been formed and filled with the via conductor, to form outgoing lines to the outside.

(6) Stacking and Pressure Bonding

As illustrated in FIG. 4, the ceramic green sheets 10, 11, 12, and 13 were stacked such that the auxiliary electrode sheet 15 was interposed between the ceramic green sheet 11 including the second discharge electrode 17 thereon and the ceramic green sheet 12 including the first discharge electrode 16 thereon and the via hole therein, the via hole being filled with the first auxiliary conductor 18, and then were subjected to pressure bonding to form a multilayer body. Here, the ceramic green sheets 10, 11, 12, and 13 were stacked such that the first auxiliary conductor 18 and a portion of the second discharge electrode 17 faced each other with the cavity portion 14 interposed therebetween. In this example, stacking and pressure bonding were performed in such a manner that the multilayer body had a thickness of about 0.3 mm.

(7) Cutting

As with the case of a chip-type electronic component, such as an LC filter, the multilayer body was divided into chips by cutting with a micro-cutter. In this example, the cutting was performed such that the chips had a length of about 1.0 mm and a width of about 0.5 mm.

(8) Firing

As with the case of a common ceramic multilayer component, the chips were fired in an $N_2$ atmosphere. In the case of an electrode material that is not oxidized, an air atmosphere may preferably be used.

(9) Application of Electrode to End Surface and Baking

After the firing, the electrode paste was applied to end surfaces and baked to form outer electrodes.

(10) Plating

The outer electrodes were subjected to electrolytic Ni—Sn plating.

ESD protection devices were completed by the steps described above, each of the ESD protection devices including the auxiliary electrode having a three-layer structure and the via conductor arranged on one side of the cavity portion in the thickness direction of the multilayer body. The discharge gap (distance between the discharge electrodes) was about 15 μm. Also in an example and a comparative example described below, the discharge gap was about 15 μm, unless otherwise specified.

Example 2

In this example, ESD protection devices were produced, each of the ESD protection devices including an auxiliary electrode having a five-layer structure, a via conductor being arranged on one side of a cavity portion in the thickness direction of a multilayer body.

Specifically, the ESD protection devices were produced in the same or substantially the same manner as in Example 1, except that an auxiliary electrode sheet having a five-layer structure of first auxiliary electrode/second auxiliary electrode/first auxiliary electrode/second auxiliary electrode/ first auxiliary electrode, was formed in the step of preparing an auxiliary electrode material described above.

Comparative Example 1

ESD protection devices were produced in the same or substantially the same manner as in Example 1, except that in the step of preparing an auxiliary electrode material described above, the auxiliary electrode material B was used to form an auxiliary electrode sheet having a single-layer structure including only the second auxiliary electrode.

Regarding the discharge starting voltage of the produced ESD protection devices, a voltage of about 1.5 kV to about 3.0 kV for contact discharge was applied in accordance with an electrostatic discharge immunity test specified in an IEC standard (IEC 61000-4-2) to measure an operating ratio. In each of the examples and the comparative example, 100 samples were evaluated. The operating ratio used here refers to the ratio of the number of the samples in which discharge occurred at a predetermined voltage to the total number of the samples.

The resistance of the produced ESD protection devices when discharge occurred repeatedly was evaluated. Specifically, a voltage of about 8 kV or about 10 kV for contact discharge was successively applied 100 times in accordance with the electrostatic discharge immunity test specified in the IEC standard (IEC 61000-4-2). A sample whose IR value was decreased to about 10 kΩ was evaluated as a failure. A sample whose IR value was not decreased to about 10 kΩ was evaluated as a non-defective product. Non-defective product ratios were compared with one another. In each of the examples and the comparative example, 50 samples were evaluated. The non-defective product ratio used here refers to the ratio of the number of the samples evaluated as the non-defective products to the total number of the samples.

In Comparative example 1, the operating ratio at about 1.5 kV was about 10% or less. In contrast, in each of Examples 1 and 2, an operating ratio of about 30% or more was obtained even at about 1.5 kV. Regarding the resistance to IR degradation, the non-defective product ratio at about 10 kV was about 10% or less in Comparative example 1, whereas the non-defective product ratio was about 50% or more in each of Examples 1 and 2.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An ESD protection device comprising:

an insulating ceramic body including a cavity portion;

an auxiliary electrode including a first main surface and a second main surface, the auxiliary electrode being embedded in the insulating ceramic body such that a side end portion of the auxiliary electrode between the first main surface and the second main surface is exposed to the cavity portion; and a first discharge electrode and a second discharge electrode that are embedded in the insulating ceramic body such that a main surface of the first discharge electrode and a main surface of the second discharge electrode face each other with the auxiliary electrode interposed therebetween; wherein the auxiliary electrode includes at least one first auxiliary electrode layer and at least one second auxiliary electrode layer;

the first auxiliary electrode layer has a higher content of a conductive material than the second auxiliary electrode layer; and the first auxiliary electrode layer is joined to at least one of the first discharge electrode and the second discharge electrode.

2. The ESD protection device according to claim 1, wherein the first discharge electrode includes a first auxiliary conductor electrically connected to the auxiliary electrode; and the first auxiliary conductor is arranged such that at least a portion of a main surface of the first auxiliary conductor is exposed to the cavity portion.

3. The ESD protection device according to claim 1, wherein the first discharge electrode includes a first auxiliary conductor electrically connected to the auxiliary electrode;

the second discharge electrode includes a second auxiliary conductor electrically connected to the auxiliary electrode; and the first auxiliary conductor and the second auxiliary conductor are arranged such that at least a portion of a main surface of the first auxiliary conductor and at least a portion of a main surface of the second auxiliary conductor are exposed to the cavity portion.

4. The ESD protection device according to claim 1, wherein the conductive material includes at least one of a metal material and a semiconductor material.

5. The ESD protection device according to claim 1, wherein the side end portion of the auxiliary electrode exposed to the cavity portion includes a surface with an irregular shape.

6. The ESD protection device according to claim 1, wherein the second auxiliary electrode layer has a larger thickness than a thickness of the first auxiliary electrode layer.

7. The ESD protection device according to claim 1, wherein the auxiliary electrode includes a through hole defining the cavity portion and having an annular shape.

8. The ESD protection device according to claim 1, wherein the at least one first auxiliary electrode layer and the at least one second auxiliary electrode layer are alternately laminated.

9. The ESD protection device according to claim 1, wherein the auxiliary electrode has a three-layer structure including one second auxiliary electrode layer that is disposed between one first auxiliary electrode layer joined to the first discharge electrode and one first auxiliary electrode layer joined to the second discharge electrode.

10. The ESD protection device according to claim 1, wherein the first auxiliary electrode layers and the second auxiliary electrode layer include a mixture of a conductive material and an insulating material.

11. The ESD protection device according to claim 1, wherein the conductive material is Cu.

12. The ESD protection device according to claim 1, wherein the conductive material is SiC.

13. The ESD protection device according to claim 1, wherein a content of the conductive material in the at least one first auxiliary electrode layer is about 15% to about 50% by volume.

14. The ESD protection device according to claim 1, wherein the content of the conductive material in the at least one first auxiliary electrode layer is about 20% to about 40% by volume.

15. The ESD protection device according to claim 1, wherein the content of the conductive material in the at least one second auxiliary electrode layer is about 3% to about 15% by volume lower than the content of the conductive material in the at least one first auxiliary electrode layers.

16. The ESD protection device according to claim 1, wherein a thickness of the auxiliary electrode is about 3 μm to about 20 μm.

17. The ESD protection device according to claim 1, wherein a thickness of the auxiliary electrode is about 5 μm to about 15 μm.

18. The ESD protection device according to claim 1, wherein a thickness of each of the at least one first auxiliary electrode layers and the at least one second auxiliary electrode layer is in a range of about 0.5 μm to about 15 μm.

19. The ESD protection device according to claim 1, wherein a thickness of each of the at least one first auxiliary electrode layers and the at least one second auxiliary electrode layer is in a range of about 1 μm to about 10 μm.

20. The ESD protection device according to claim 1, wherein the first discharge electrode and the second discharge electrode are arranged in different planes.

* * * * *